US007921618B2

(12) United States Patent
Lovald et al.

(10) Patent No.: US 7,921,618 B2
(45) Date of Patent: Apr. 12, 2011

(54) MODULAR FLOORING SYSTEM

(75) Inventors: David K. Lovald, Middlesex, VT (US); Barry S. McVey, Essex Junction, VT (US); Nancy L. Hoblin, Woodstock, VT (US)

(73) Assignee: Bike Track, Inc., Woodstock, VT (US)

( * ) Notice: Subject to any disclaimer, the term of this patent is extended or adjusted under 35 U.S.C. 154(b) by 198 days.

(21) Appl. No.: 12/357,881

(22) Filed: Jan. 22, 2009

(65) Prior Publication Data

US 2009/0126294 A1 May 21, 2009

Related U.S. Application Data

(62) Division of application No. 11/680,802, filed on Mar. 1, 2007, now Pat. No. 7,490,443.

(60) Provisional application No. 60/778,012, filed on Mar. 1, 2006.

(51) Int. Cl.
*E04B 2/00* (2006.01)

(52) U.S. Cl. ..... 52/582.2; 52/590.2; 52/591.5; 52/592.1

(58) Field of Classification Search ..... 52/597, 52/604, 592.2, 590.2, 587.1, 591.5, 588.1, 52/582.2, 592.1
See application file for complete search history.

(56) References Cited

U.S. PATENT DOCUMENTS

| | | | | | |
|---|---|---|---|---|---|
| 16,692 | A | | 2/1857 | Mettam | |
| 22,035 | A | * | 11/1858 | Savage | 34/237 |
| 746,399 | A | * | 12/1903 | Staples | 52/591.5 |
| 828,930 | A | * | 8/1906 | Crampton | 52/587.1 |
| 954,983 | A | * | 4/1910 | Melber | 52/438 |
| 1,509,659 | A | * | 9/1924 | Luchich et al. | 404/41 |
| 2,231,780 | A | | 2/1941 | Swenson | |
| 2,394,443 | A | | 2/1946 | Guignon, Jr. | |
| 2,407,059 | A | | 9/1946 | Crafton | |
| 2,647,287 | A | * | 8/1953 | Jones | 52/582.2 |
| 2,950,575 | A | | 8/1960 | August | |
| 3,420,018 | A | | 1/1969 | Fork | |
| 3,494,381 | A | | 2/1970 | Fork | |
| 3,512,324 | A | | 5/1970 | Reed | |
| 3,538,819 | A | | 11/1970 | Gould, Jr. et al. | |
| 3,771,891 | A | | 11/1973 | Nirenski et al. | |
| 3,815,304 | A | | 6/1974 | Schille et al. | |
| 4,152,875 | A | | 5/1979 | Soland | |
| 4,438,614 | A | * | 3/1984 | Raith et al. | 52/580 |
| 4,612,746 | A | | 9/1986 | Higgins | |
| 4,749,302 | A | | 6/1988 | DeClute | |
| 4,773,196 | A | | 9/1988 | Yoshida et al. | |

(Continued)

OTHER PUBLICATIONS

Bike Track, Inc. brochure, Eco Track Modular Flooring Systems for Military Applications.

(Continued)

*Primary Examiner* — Robert J Canfield
*Assistant Examiner* — Charissa Ahmad
(74) *Attorney, Agent, or Firm* — Downs Rachlin Martin PLLC

(57) ABSTRACT

A modular flooring system that includes a plurality of interlocking floor panels arrangeable into a variety of configurations. In one embodiment, each interlocking floor panel includes tongues and grooves that allow adjacent ones of the panels to connect with one another by the mating of tongues and grooves. A locking mechanism can be provided to one or more of the floor panels for locking the connected panels together. In other embodiments, the modular flooring system includes either integrally formed conduit chases or separately formed conduit chases, or a combination of both.

7 Claims, 13 Drawing Sheets

U.S. PATENT DOCUMENTS

| | | | | | |
|---|---|---|---|---|---|
| 4,917,532 | A | | 4/1990 | Haberhauer et al. | |
| 4,930,286 | A | | 6/1990 | Kotler | |
| 5,152,632 | A | | 10/1992 | Hawkes | |
| 5,197,244 | A | | 3/1993 | Takeda et al. | |
| 5,204,149 | A | * | 4/1993 | Phenicie et al. | 428/57 |
| 5,205,092 | A | | 4/1993 | Taylor | |
| 5,216,861 | A | * | 6/1993 | Meyerson | 52/586.2 |
| 5,267,367 | A | | 12/1993 | Wegmann, Jr. | |
| 5,341,614 | A | | 8/1994 | Shimizu | |
| 5,424,118 | A | * | 6/1995 | McLaughlin | 428/314.8 |
| 5,425,214 | A | | 6/1995 | Truelove et al. | |
| 5,489,458 | A | | 2/1996 | Sato et al. | |
| 5,499,888 | A | | 3/1996 | Hawkes | |
| 5,595,038 | A | * | 1/1997 | Prestenback | 52/592.1 |
| 5,630,300 | A | | 5/1997 | Chen | |
| 5,673,524 | A | * | 10/1997 | Gailey | 52/309.9 |
| 5,787,654 | A | | 8/1998 | Drost | |
| 5,833,386 | A | * | 11/1998 | Rosan et al. | 404/36 |
| D406,360 | S | * | 3/1999 | Finkell, Jr. | D25/138 |
| 6,021,646 | A | | 2/2000 | Burley et al. | |
| 6,032,427 | A | * | 3/2000 | Randjelovic | 52/584.1 |
| 6,032,428 | A | * | 3/2000 | Rosan et al. | 52/592.1 |
| 6,061,979 | A | | 5/2000 | Johannes | |
| 6,061,982 | A | | 5/2000 | Owen | |
| 6,076,315 | A | | 6/2000 | Kondo | |
| 6,089,784 | A | * | 7/2000 | Ardern | 404/41 |
| 6,164,026 | A | | 12/2000 | Ehrenkrantz | |
| 6,170,212 | B1 | | 1/2001 | Suchyna et al. | |
| 6,274,809 | B1 | | 8/2001 | Pudims et al. | |
| 6,314,701 | B1 | * | 11/2001 | Meyerson | 52/588.1 |
| 6,526,710 | B1 | | 3/2003 | Killen | |
| 6,598,366 | B2 | | 7/2003 | Hsieh et al. | |
| 6,647,690 | B1 | * | 11/2003 | Martensson | 52/601 |
| 6,694,689 | B1 | | 2/2004 | Scott et al. | |
| 6,733,206 | B2 | | 5/2004 | Stasiewich et al. | |
| 6,739,797 | B1 | | 5/2004 | Schneider | |
| 6,769,835 | B2 | * | 8/2004 | Stridsman | 404/41 |
| 6,845,591 | B1 | | 1/2005 | van Paassen et al. | |
| 7,047,697 | B1 | * | 5/2006 | Heath | 52/177 |
| 7,461,482 | B2 | * | 12/2008 | Cerasi et al. | 52/177 |
| 7,543,418 | B2 | * | 6/2009 | Weitzer | 52/592.1 |
| 7,621,092 | B2 | * | 11/2009 | Groeke et al. | 52/586.1 |
| 7,716,895 | B2 | * | 5/2010 | Fairorth et al. | 52/582.2 |
| 2001/0039781 | A1 | * | 11/2001 | Oh et al. | 52/745.05 |
| 2003/0084626 | A1 | | 5/2003 | Hsieh et al. | |
| 2004/0035079 | A1 | * | 2/2004 | Evjen | 52/592.1 |
| 2004/0123546 | A1 | * | 7/2004 | Stull et al. | 52/578 |
| 2005/0204676 | A1 | * | 9/2005 | Weitzer | 52/578 |
| 2006/0080909 | A1 | | 4/2006 | Harding et al. | |
| 2007/0006543 | A1 | * | 1/2007 | Engstrom | 52/582.1 |
| 2007/0028547 | A1 | * | 2/2007 | Grafenauer et al. | 52/586.1 |
| 2007/0277453 | A1 | | 12/2007 | Trageser et al. | |
| 2007/0283658 | A1 | * | 12/2007 | Siewert et al. | 52/590.2 |
| 2008/0066415 | A1 | * | 3/2008 | Pervan et al. | 52/588.1 |

OTHER PUBLICATIONS

Bike Track, Inc. brochure, Tactical Command Post Staging System.
First Office Action dated May 23, 2008 regarding related U.S. Appl. No. 11/680,802.
Response to First Office Action dated Aug. 22, 2008 regarding related U.S. Appl. No. 11/680,802.
Notice of Allowance dated Oct. 21, 2008 regarding related U.S. Appl. No. 11/680,802.

* cited by examiner

MODULAR FLOORING SYSTEM

RELATED APPLICATION DATA

This is a divisional of U.S. Nonprovisional patent application Ser. No. 11/680,802, filed on Mar. 1, 2007, and titled "Modular Flooring System," now U.S. Pat. No. 7,490,443, that claims the benefit of priority of U.S. Provisional Patent Application Ser. No. 60/778,012, filed Mar. 1, 2006, and titled "Interlocking Modular Flooring System." These applications are incorporated by reference herein in their entirety.

FIELD OF THE INVENTION

The present invention generally relates to the field of flooring systems. In particular, the present invention is directed to a modular flooring system.

BACKGROUND

Modular flooring systems are useful in many applications. For example, in a military application, military personnel may desire to establish a tactical command post during training or combat situations. However, the physical terrain may be too wet, sandy, soft or otherwise unsuitable to properly assemble or operate the necessary equipment. Additionally, the ground may include unwanted vegetation or tree roots, which increases the likelihood that a soldier may trip or slip, possibly injuring himself/herself, someone else, and/or expensive military equipment. Modular flooring systems allow such military personnel to create a dry, sturdy base that is suitable for assembling such a tactical command post.

Modular flooring systems are not limited to military applications. Alternatively, modular flooring systems may be used in any number of indoor and outdoor applications, such as trade shows, factory floors, temporary roadways, outdoor gatherings, and stages. Conventional modular flooring systems are typically formed of various arrangements of multiple floor panels. However, these conventional modular flooring systems have a number of drawbacks. For example, they can be difficult to transport because of the large size and bulk of the individual panels. They can require special tools and/or experienced personnel for proper assembly. Connections between floor panels may not have enough flexibility for the panels to be used over uneven ground. If these connections are used in installations over uneven ground, components of the connections may separate inadvertently or break. Additionally, many modular flooring systems do not allow for full positive connectivity throughout the system, or allow for infloor routing and distribution of cable and wire.

SUMMARY OF THE DISCLOSURE

In one embodiment, the present disclosure is directed to a floor panel for a modular flooring system. The floor panel includes: a platelike body having a treading surface, first and second sides spaced from one another and third and fourth sides spaced from one another; a first tongue located on the first side and extending downward substantially perpendicular to and away from the treading surface; a first extension member extending laterally from the second side and defining an upwardly opening first groove configured to receive a second tongue of a first like floor panel, the second tongue being substantially identical to the first tongue; the first tongue configured to engage a second groove of a second like floor panel, the second groove being substantially identical to the first groove; and a first locking mechanism that includes a first locking member slidingly engageable with the first like floor panel or the second like floor panel in a direction substantially parallel to the treading surface so as to either lock the second tongue in the first groove when the first like floor panel is engaged with the platelike body or lock the first tongue in the second groove when the platelike body is engaged with the second like floor panel.

In a further embodiment, the present disclosure is directed to a modular flooring system. The floor system includes: a plurality of interlocking floor panels each including: a rectangular treading surface having a first edge, a second edge spaced from the first edge, a third edge, and a fourth edge spaced from the third edge; a first extension member extending laterally beyond the first edge and defining an upwardly opening first groove; a second extension member extending laterally beyond the third edge and defining an upwardly opening second groove; a first tongue below the second edge and extending substantially perpendicular to and away from the treading surface; a second tongue below the fourth edge and extending substantially perpendicular to and away from the treading surface; and a plurality of locking mechanisms; wherein the plurality of interlocking floor panels are interlocked with one another such that ones of the first tongues are engaged with ones of the first grooves, ones of the second tongues are engaged with ones of the second grooves, and the plurality of locking mechanisms are engaged so as to lock immediately adjacent panels to one another to hold ones of the first tongues in corresponding respective ones of the first grooves and to hold ones of the second tongues in corresponding respective ones of the second grooves.

In yet another embodiment, the present disclosure is directed to a modular flooring system. The modular flooring system includes: a plurality of interlocking floor panels each including: a rectangular treading region having a first edge, a second edge spaced from the first edge, a third edge, and a fourth edge spaced from the third edge; a first extension member extending laterally beyond the first edge and defining an upwardly opening first groove; a second extension member extending laterally beyond the third edge and defining an upwardly opening second groove; a first tongue below the second edge and extending substantially perpendicular to and away from the treading surface; and a second tongue below the fourth edge and extending substantially perpendicular to and away from the treading surface; wherein: the plurality of interlocking floor panels are interlocked with one another such that ones of the first tongues are engaged with ones of the first grooves, ones of the second tongues are engaged with ones of the second grooves; and ones of the plurality of interlocking floor panels include corresponding respective integral conduit chase segments having troughs formed relative to corresponding respective ones of the treading surfaces, the plurality of interlocking floor panels arranged so that the corresponding respective integral conduit chase segments are contiguous so as to form at least one conduit chase.

In still a further embodiment, the present disclosure is directed to a yet another floor panel for a modular flooring system. The floor panel includes: a platelike body having a treading surface, first and second sides spaced from one another and third and fourth sides spaced from one another; a first tongue located on the first side and extending downward substantially perpendicular to and away from the treading surface; and a first extension member extending laterally from the second side and defining an upwardly opening first groove configured to receive a second tongue of a first like floor panel, the second tongue being substantially identical to the first tongue; wherein: the first tongue is configured to engage a second groove of a second like floor panel, the second groove being substantially identical to the first groove; and the first tongue includes a first self-alignment tab for assisting in aligning, in a direction parallel to the first side, the floor panel with a like floor panel having a corresponding first self-alignment receiver as the first self-alignment tab is engaged with the first self-alignment receiver.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 1:
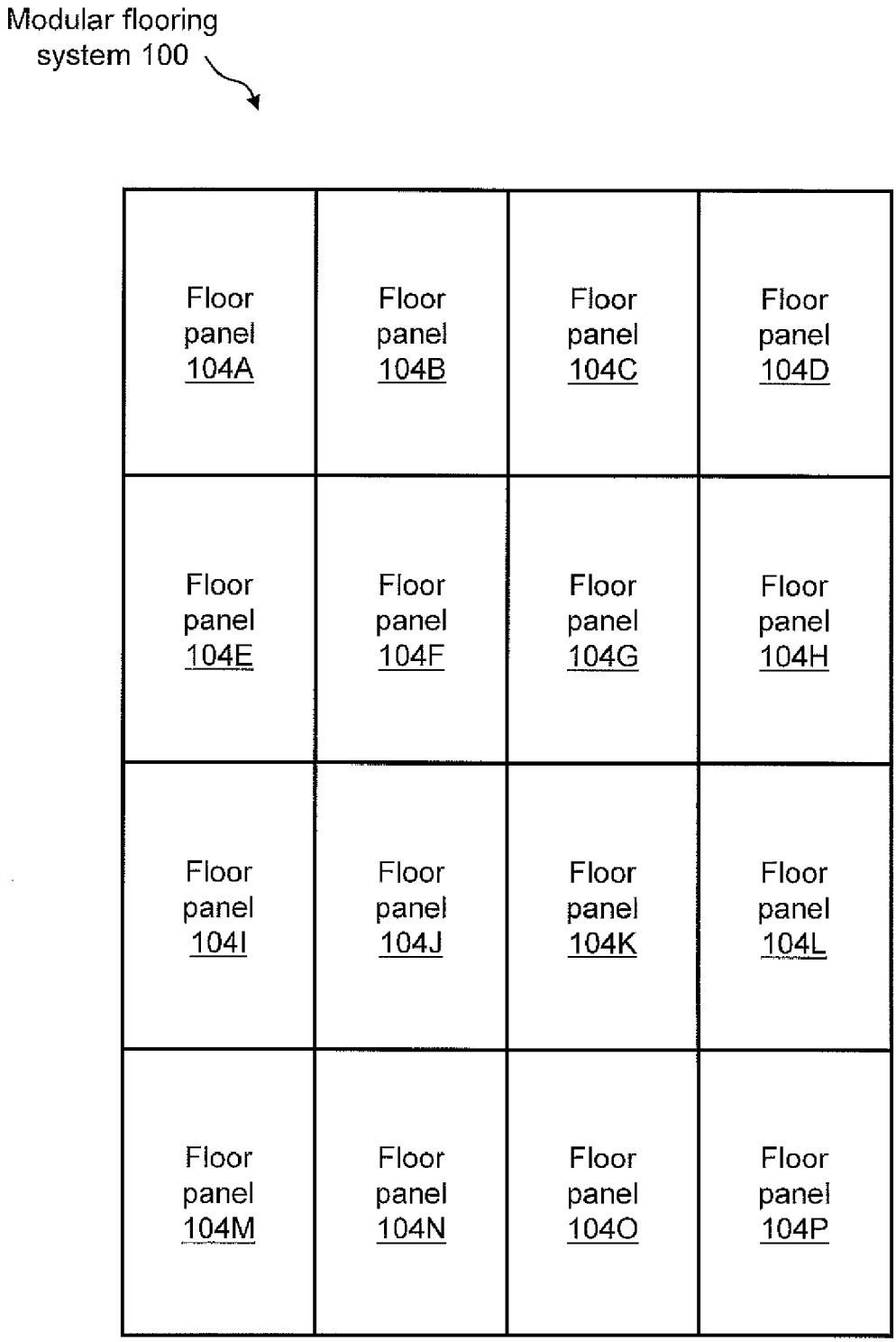
FIG. 1 is a schematic top view of an example of a modular flooring system made in accordance with the present invention.

Referring now to the drawings, FIG. 1 illustrates an example 100 of a modular flooring system that comprises two or more like interlocking panels, here 16 like panels 104A-P, that includes features that can provide the flooring system with a number of benefits over conventional modular flooring systems. Some of these benefits include ease of transporting and assembling flooring system 100 and the ability of the flooring system to provide a robust floor even when placed over uneven or otherwise less than ideal ground. Features of interlocking panels 104A-P that provide these and other benefits are illustrated below in detail. As those skilled in the art will readily appreciate, the 4-panel-by-4-panel arrangement of interlocking floor panels 104A-P in flooring system 100 is only exemplary. The 16 interlocking floor panels 104A-P, or more or fewer like panels, may be arranged in any user-defined configuration of rows and columns that the interlocking and other features of floor panels made in accordance with the present disclosure will allow.

In addition, it will be appreciated that while each interlocking floor panel 104A-P is shown as being rectangular in shape, each panel may have another shape, e.g., a rectilinear shape such as square, hexagonal, trapezoidal, sawtooth, etc., or a shape having both curvilinear and rectilinear edges, such as sinusoid-like edges on two opposing sides and straight edges on the remaining sides, among others. Furthermore, not all of the interlocking floor panels need to have the same size and/or same shape for any given flooring system. For example, in some alternative embodiments, some of the interlocking panels may be rectangular while others may be squares each half the size of the rectangular panel. In other alternative embodiments, some of the interlocking panels may be circular while others of the panels may be relatively large panels that each may be considered a rectangular panel having its corners replaced by quarter-circle cutouts that conformally engage the circular panels. In this arrangement, four "rectangular" panels can be arranged around each circular panel. It should be readily appreciated that the universe of interlocking floor panels made in accordance with features disclosed herein is very large.

Each interlocking floor panel 104A-P may be made of one or more suitable materials, e.g., materials that exhibit strength and durability under the anticipated conditions. Examples of such materials include high density polyethylene and fiber-reinforced plastic, among many others. The choosing of one or more materials will be well within the ordinary skill of a panel designer. The width, length, and thickness of each interlocking floor panel 104A-P can differ from one application to another. In one example, the length of each interlocking floor panel 104A-P is 42 inches (106.68 cm), the width is 24 inches (53.34 cm), and the overall thickness including the ribs is one inch (2.54 cm). In another example, the length of each interlocking floor panel 104A-P is 72 inches (182.88 cm), the width is 48 inches (106.68 cm), and the overall thickness is two inches (2.54 cm). Of course, these dimensions are only exemplary. Considerations in selecting dimensions include convenience of handling, type of material from which interlocking floor panels 104A-P are made, expected variation in the terrain upon which the panels are used, and the construction of the floor panels, such as, but not limited to, ribbed, perforated, and/or reinforced, among others, or any combination thereof. More details of each interlocking floor panel 104A-P are shown in FIGS. 2-9.

Figure 2:
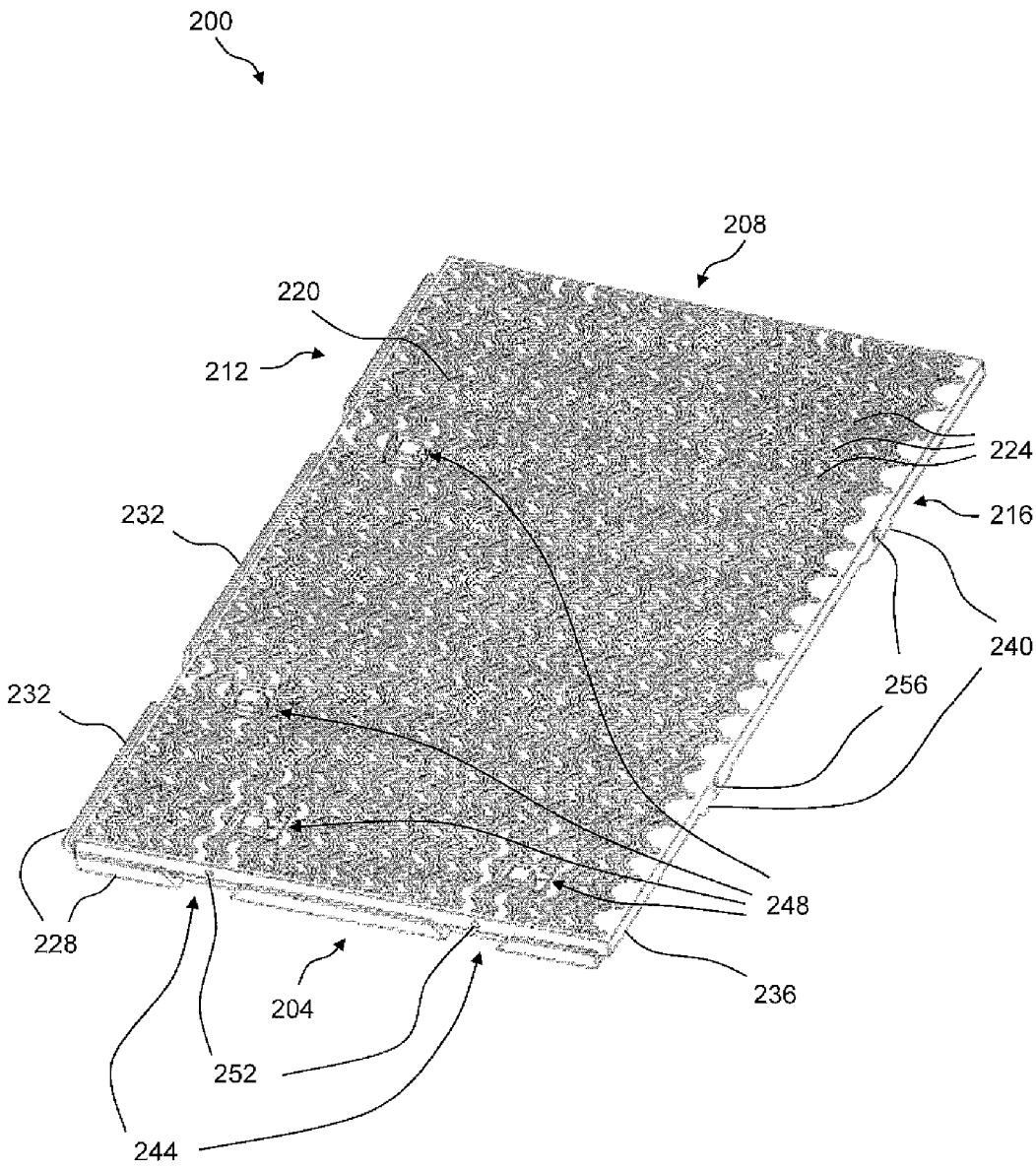
FIG. 2 is an enlarged isometric view of an interlocking floor panel suitable for use in the modular flooring system of FIG. 1 showing the treading surface of the floor panel.

FIG. 2 illustrates an exemplary interlocking floor panel 200 that could be used in modular flooring system 100 of FIG. 1, along with a plurality of panels like or similar to floor panel 200. Interlocking floor panel 200 can be considered to include a first end 204, a second end 208, a first side 212, a second side 216, and an upper, or treading, surface 220. Treading surface 220 may, but need not, have a textured pattern or other attribute provided to enhance traction. An example of a textured pattern suitable for a number of applications is disclosed in U.S. Pat. No. 5,499,888 to Hawkes, issued Mar. 19, 1996, and titled "Bidirectional Roadway For Wheeled Vehicles" (currently assigned to Bike Track Inc.) that is incorporated by reference herein in its entirety. Interlocking floor panel 200 may further include, if desired, a plurality of holes 224 or other features that extend between treading surface 220 and a lower surface (shown at element 300 in FIG. 3). Holes 224 may be designed to allow water and other liquids to drain through interlocking floor panel 200. Holes 224 may also allow granular solids to fall through or be swept through interlocking floor panel 200. Additionally, holes 224 may be provided to reduce the weight of interlocking floor panel 200, which can be desirable to enhance shippability and handlability.

Figure 4:
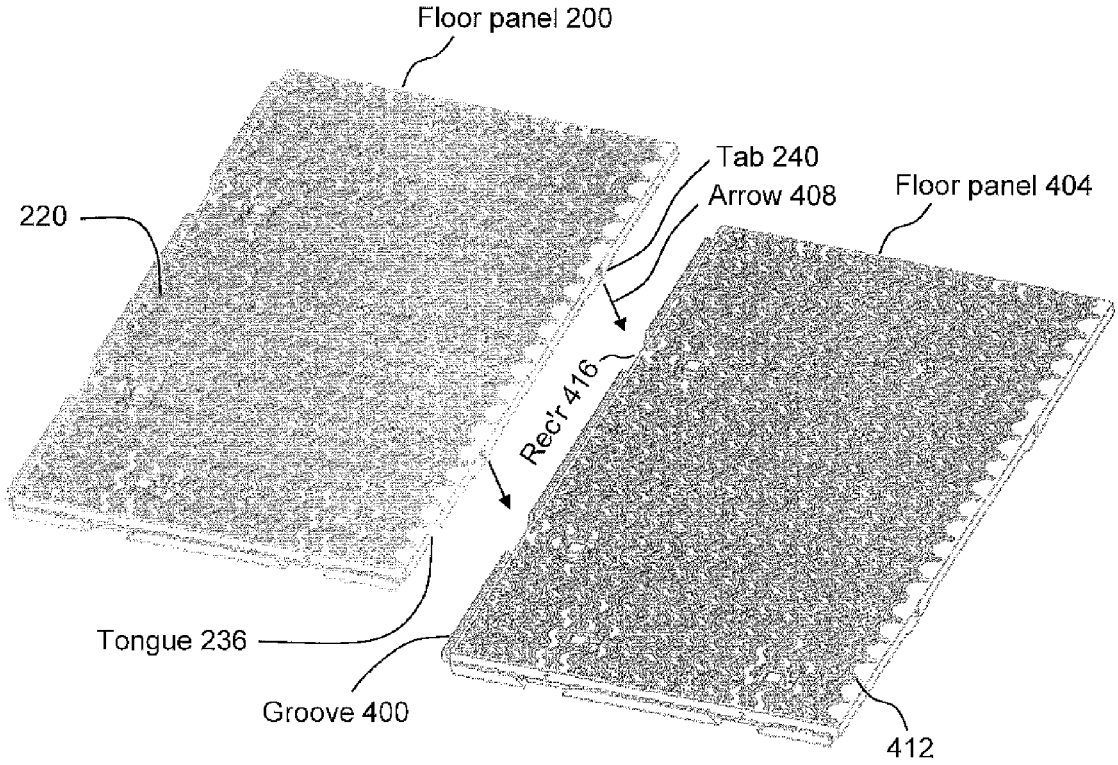
FIG. 4 is an enlarged perspective view of the floor panel of FIGS. 2 and 3 being engaged with an already placed, like floor panel.

Each of first end 204 and first side 212 (or other combination of ends 204, 208 and sides 212, 216) may each include one or more extension members 228 that each define a corresponding respective groove 232, and second end 208 and second side 216 (or other complementary combination of ends 204, 208 and sides 212, 216) may each include one or more tongues 236 for engaging at least one or more grooves of an adjacent interlocking floor panel, e.g., as seen with groove 400 adjacent interlocking floor panel 404 of FIG. 4, that are the same as or similar to grooves 232 of interlocking floor panel 200, of FIG. 2. In FIG. 4, interlocking floor panel 404 can be considered to be resting on the ground (not shown) or other surface and, correspondingly, interlocking floor panel 200 can be considered to be located above the ground and to the left of floor panel 404 as it is being moved toward interconnecting engagement with floor panel 404, as indicated by arrows 408.

Figure 3:
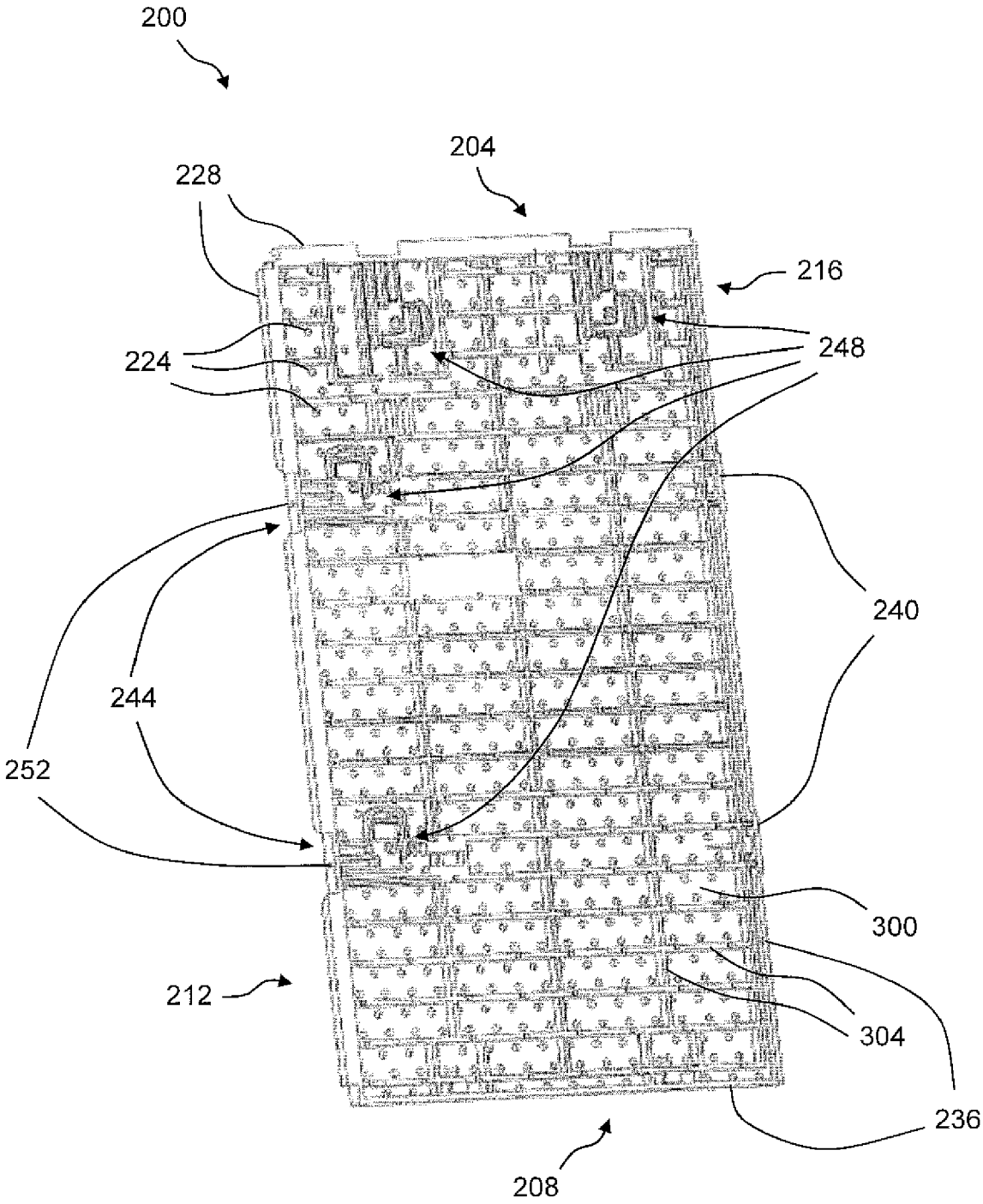
FIG. 3 is an enlarged isometric view of the floor panel of FIG. 2 showing the bottom of the floor panel.

FIG. 3 shows the underside of exemplary interlocking floor panel 200 as including lower surface 300 and a plurality of ribs 304. Ribs 304 may be provided, e.g., to maintain the strength of interconnecting floor panel 200 while allowing the weight of the floor panel to be reduced and also to transmit load from treading surface 220 to the underlying supporting surface, e.g., ground, at frequent intervals so as to increase load-bearing capability of interlocking floor panel 200. Ribs 304, if provided, may be designed in any number of patterns. In one embodiment, ribs 304 run both lengthwise and widthwise along lower surface 300 of interlocking floor panel 200, as shown in FIG. 3. In other embodiments, the ribs may run in any number of patterns and orientations. Additionally, if desired, ribs 304 may be designed to interlock or otherwise interact with a textured pattern on treading surface 220 (FIG. 2) to inhibit interlocking floor panel 200 from sliding relative to another similar floor panel when floor panel 200 is stacked on the other floor panel for storage or transportation.

In one embodiment, ribs 304 present in the interior of lower surface 300 (relative to the outer periphery of floor panel 200) may extend from treading surface 220 a distance that is less than the distance of ribs 304 present at the periphery of the floor panel so that the difference between the two distances is equal to or greater than the height of the textured pattern on the treading surface. Correspondingly, the textured pattern on treading surface 220 may be removed from the adjacent outer edge of the treading surface to provide the deeper outer ones of ribs 304 a space to rest and, thereby, inhibit a plurality of interlocking floor panels 200 from sliding relative to one another when stacked. In other embodiments, lower surface 300 may include lugs (See, e.g., FIGS. 8-10) that protrude farther than ribs 304. The textured pattern on treading surface 220 may be configured to accept lugs when interlocking floor panels 200 are stacked on a like panel and, thereby, not allow the panels to slide relative to one another when stacked for storage or transportation. As yet another alternative, the protruding lugs (see, e.g., FIGS. 8-10) may be provided on ones of ribs 304 so as to interact with features of treading surface 220 of another panel that is like floor panel 200 so as to inhibit sliding of the panels relative to one another while stacked.

Referring to FIG. 4, the thickness of tongue 236 on interlocking floor panel 200 and the width of groove 400 on floor panel 404 may be designed such that the tongue fits within the groove to properly connect the adjacent interlocking panels to one another so that the panels are inhibited from moving away from one another in a direction perpendicular to the longitudinal axes of the mating tongue and groove. With this configuration, it is not necessary to tilt or angle one interlocking floor panel, e.g., floor panel 200, when engaging it with another interlocking floor panel, such as floor panel 404, because tongue 236 of floor panel 200 may simply be laid in groove 400 of floor panel 404 with the treading surfaces 220, 412 of the panels parallel or substantially parallel to one another. In some embodiments, the thickness of the tongue(s), here tongue 236, may be designed to be less than the width of groove(s), here groove 400, to allow a certain amount of movement, e.g., rotation, between adjacent interlocking floor panels, e.g., floor panels 200, 404. This configuration can be beneficial for accommodating, e.g., uneven terrain and/or other impediments to achieving an ideal planar floor. For example, in some embodiments, floor panels 200, 404 may be configured to allow up to about 10° to 20° of rotation of the floor panels relative to one another along their common joint, depending, e.g., on the overall thickness of the floor panels. For example, in an embodiment in which the adjoining panels have an overall thickness of about 1 inch, the maximum relative rotation approaches about 10° for the tongue and groove configuration alone, with some additional rotation being accommodated by flexure of the panels. In another embodiment in which the panels have an overall thickness of about 2 inches, the maximum relative rotation approaches about 20° due to the tongue and groove configuration. The 2-inch example is fairly stiff, so that flexure of the panels does not have a significant contribution.

Referring again to FIGS. 2 and 3, in some embodiments, one or more of the tongues on one or both of the tongued edges, here tongues 236 on second end 208 and second side 216, can include one or more "self-alignment" tabs 240, and, correspondingly, one or more of the extension members on the other edges, here extension members 228 on first end 204 and first side 212, can include one or more receivers 244 for receiving the corresponding respective tabs of an adjacent interlocking floor panel. This is illustrated by arrows 408 in FIG. 4 that indicate tabs 240 of interlocking floor panel 200 being engaged with corresponding respective receivers 416 of interlocking floor panel 404. The length of each tab 240 (FIGS. 2-4) along the length of the respective peripheral tongue 236 of interlocking floor panel 200 and the length of each corresponding receiver of another interlocking floor panel, e.g., each receiver 416 of floor panel 404, may be selected such that the tabs engage the receivers tightly or with little play so as to inhibit movement between the interconnected panels in a direction parallel to the corresponding respective tongue(s) and groove(s), e.g., tongue 236 and groove 400 in FIG. 4. Additionally, each tab 240 may be tapered such that it is wider at the end of the tab proximate treading surface 220 of interlocking floor panel 200 than at the end of the tab distal from the treading surface. Correspondingly, the sides of the corresponding receivers 416 may also be angled to conformally receive tapered tabs 240. Tapering tabs 240 and angling receivers 416 in this manner allows interlocking floor panel 200 to self-align easily with interlocking floor panel 404 when laying floor panel 200.

An interlocking floor panel of the present disclosure, such as floor panel 200 of FIGS. 2 and 3, may further include one or more locking mechanisms, such as locking mechanisms 248, for locking the floor panel to one or more adjacent like floor panels in conjunction with extension members 228 and tongues 236 and, if provided, tabs 240 and receivers 244. For example and referring again to FIG. 1, floor panel 104A is locked to floor panel 104B and to floor panel 104E by use of locking mechanisms the same as or similar to locking mechanism 248 of FIGS. 2 and 3. When engaged with another like panel, locking mechanisms 248 inhibits the interconnected ones of the floor panels from becoming disconnected inadvertently and also inhibits unintended lateral, longitudinal and vertical movement between the floor panels. In some embodiments, including the embodiment shown in FIGS. 2 and 3, portions of locking mechanisms 248, are molded as integral parts of interlocking floor panel 200. In other embodiments (not shown), the locking mechanism may be formed separately from the rest of interlocking floor panel 200 and secured thereto. Details of exemplary locking mechanism 248 are shown in FIGS. 5-7 and described below.

Figure 5:
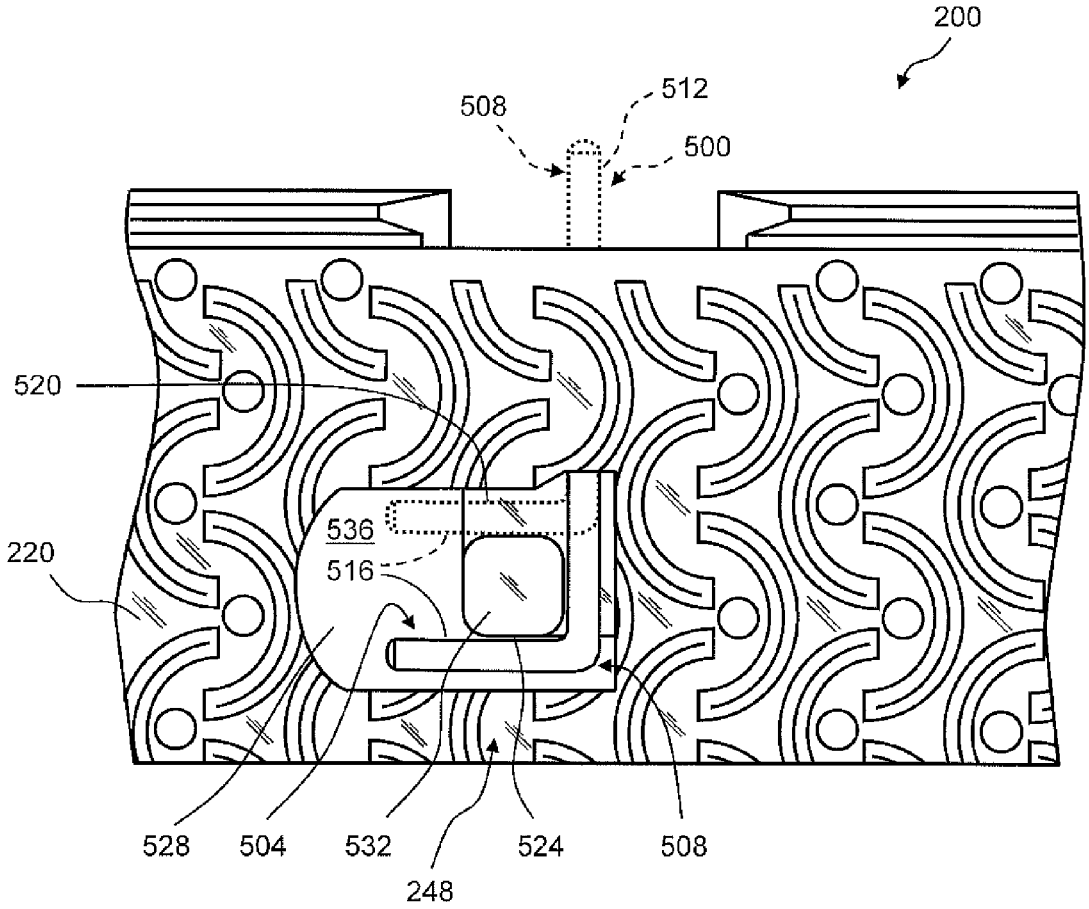
FIG. 5 is an enlarged top view of the floor panel of FIGS. 2 and 3 showing one of the locking mechanisms of the floor panel in an unlocked state (solid-lined locking pin) and in a locked state (dashed-line locking pin)
Figure 6:
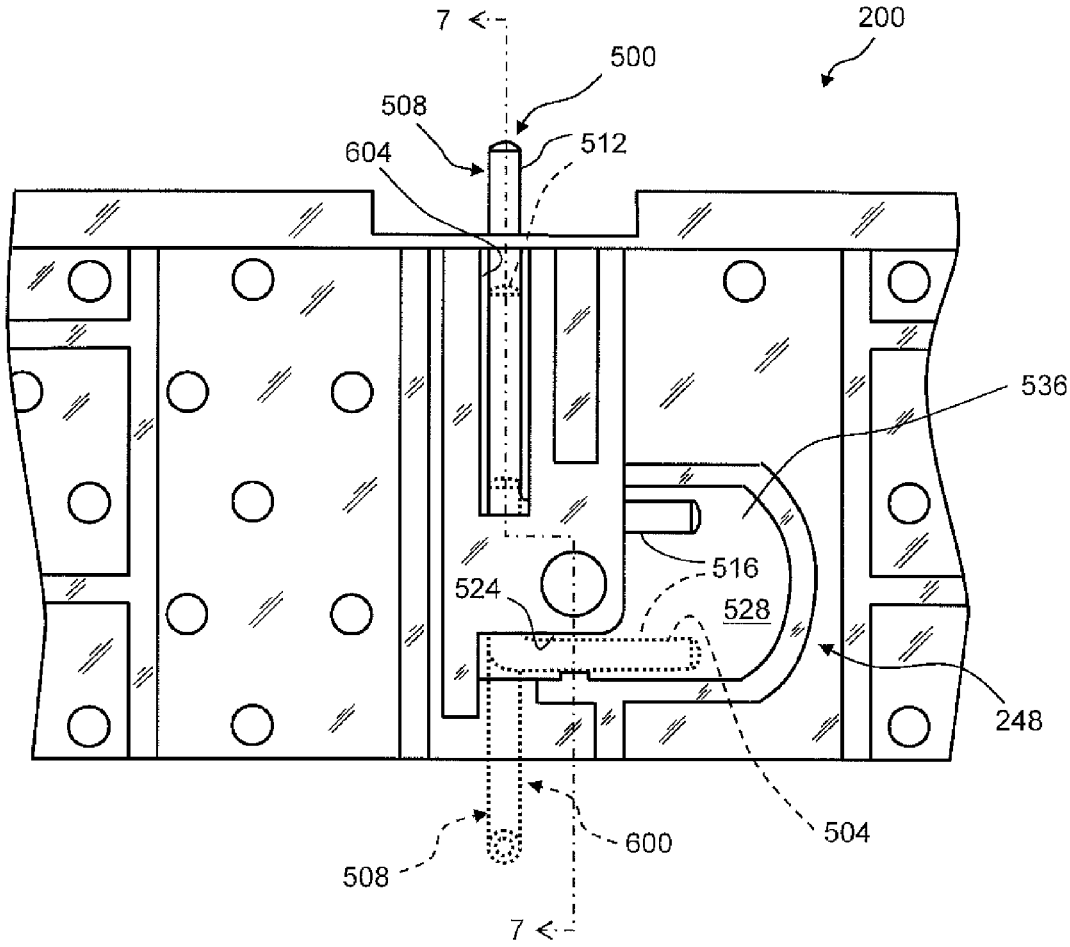
FIG. 6 is an enlarged bottom view of the locking mechanism of FIG. 5 showing the locking mechanism in a locked state (solid-line locking pin), in an unlocked state (dashed-line locking pin) and in a locking pin removal state (dotted-line locking pin)
Figure 7:
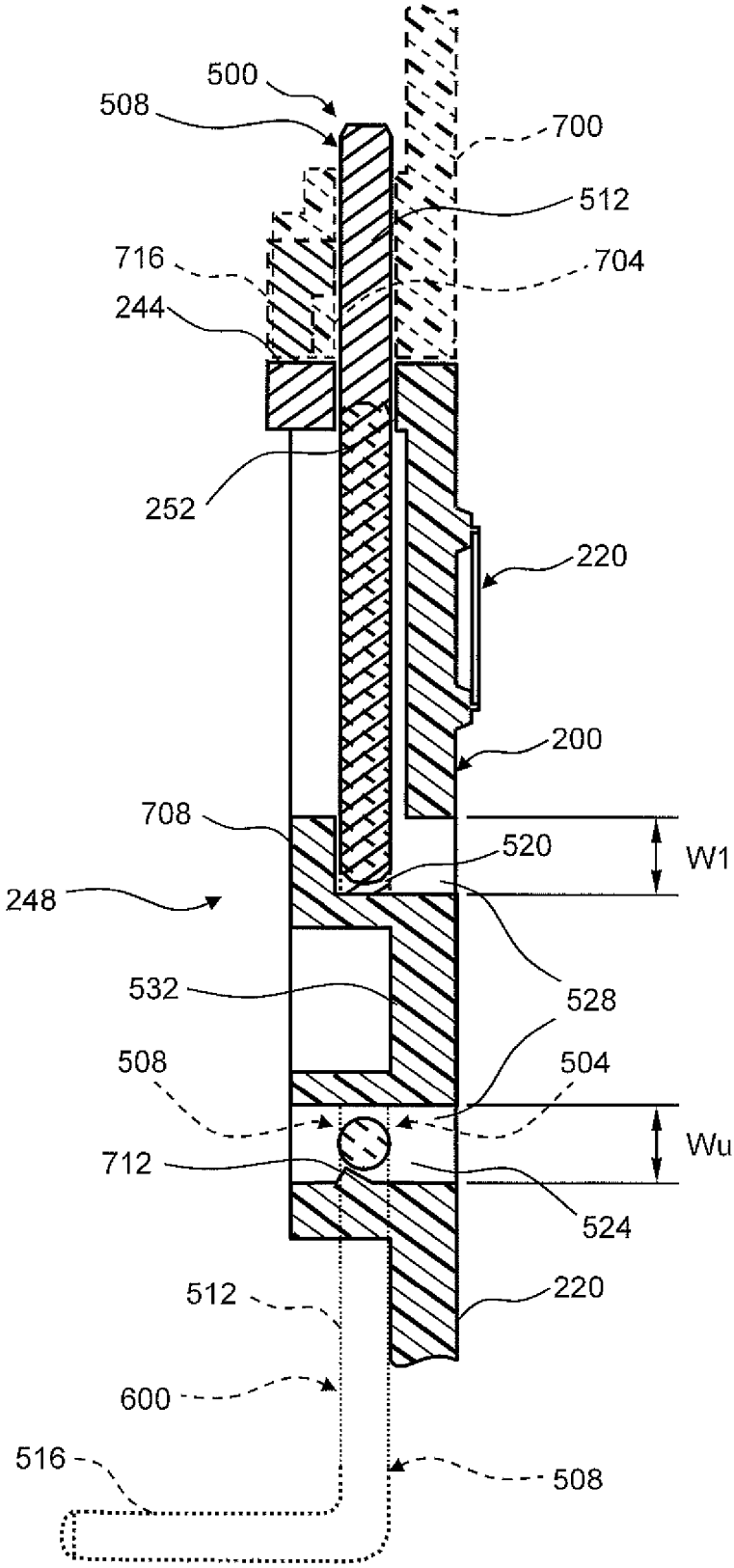
FIG. 7 is an enlarged cross-sectional view of the locking mechanism of FIG. 4 as taken along line 7-7 of FIG. 6 showing the locking mechanism in a locked state (solid-line locking pin), in an unlocked state (dashed-line locking pin) and in a locking-pin-removal state (dotted-line locking pin)

Each of FIGS. 5-7 illustrates locking mechanism 248 of interlocking floor panel 200 of FIGS. 2 and 3 in both a locked state 500 and a stowed unlocked state 504. Locked state 500 is the desired state for interlocking floor panel 200 with an adjacent, like floor panel, e.g., panel 700 of FIG. 7, when the resulting modular flooring system, such as modular flooring system 100 of FIG. 1, is in use as a floor. In locked state, a locking member 508 extends through an exit aperture 252 (FIGS. 2 and 7) so that it can engage a corresponding entrance aperture of like floor panel, such as entrance aperture 704 of like floor panel 700 (which is also similar to entrance aperture 256 on interlocking floor panel 200 of FIG. 2). As described below in more detail, when locking mechanism 248 is in locked state 500, locking member 508 is stowed so that it does not project above treading surface 220 (FIGS. 5 and 7) of floor panel 200 where it could interfere with the use of resulting floor. Stowed unlocked state 504, on the other hand, is an unlocked state in which locking member 508 (shown in the stowed unlocked state as being dashed) remains engaged with locking mechanism 248 but is "retracted" into interlocking floor panel 200 and is stowed so as to not project above treading surface 220 of the floor panel. In this retracted state, locking member 508 does not interfere with engaging interlocking floor panel 200 with another, like floor panel, such as panel 700 of FIG. 7. In addition to locked state 500 and unlocked state 504, each of FIGS. 6 and 7 also show locking mechanism 248 in a locking-member-removal state 600 to show how locking member 508 (shown in the locking-member-removal state in dotted lines) can be removed from the locking mechanism (and also replaced). Each of stowed unlocked state 504 and locking-member-removal state 600 is described below in more detail.

In the embodiment shown in FIGS. 5-7, locking member 508 is made of a suitable material, such as metal (e.g., stainless steel), among others. As can be readily seen, locking member 508 may be a one-piece, solid, cylindrical rod, or pin, that is bent or otherwise formed in the shape on an "L" so as to have a first portion 512 and a second portion 516 perpendicular to the first portion. Second portion 516 functions as a handle that a user can use to move locking member 508 between, e.g., unlocked state 504 and locked state 500 as desired. In one example, the diameter of locking pin 508 is 5/16 inch (7.94 mm), the length of first portion 512 may be four inches (20.16 cm), and the length of second portion 516 may be two inches (5.08 cm). One or both ends of locking member 508 may be tapered, bevel, rounded, etc. as desired. For example, the end of locking member 508 that engages the entrance aperture of another interlocking floor panel can benefit from any one of these treatments to assist in the engagement of the locking member with that entrance aperture. While locking member 508 is shown as being a single pin-type member, it will be recognized that other configurations, including more elaborate configurations such as multi-finger sliding members actuated by a lever, can be used if desired. An advantage of the single pin configuration shown, however, is that it is relatively inexpensive to implement and is highly resistant to mechanical failure.

As best seen in FIG. 6, first portion 512 of locking member 508 may be movable longitudinally within a channel 604 formed in the underside of interlocking floor panel 200. Channel 604, if provided, should have a width that allows locking member 508 to move freely or with a desired amount of frictional resistance. If channel 604 is wider than the outside diameter of locking member 508, exit aperture 252 (FIGS. 2 and 7) and the locking member can be designed to have a snug fit with each other so that the locking member has at least some resistance to free movement along the longitudinal axis of first portion 512 of the locking member. This resistance can be desirable from operation and feel points of view.

To achieve each of locked state 500 and stowed unlocked state 504, i.e., states in which second portion 512 of locking member 508 and second portion 516 are alternately positioned in a locked stowing region 520 (FIGS. 5 and 7) and an unlocked stowing region 524 (FIGS. 5-7), respectively. Locked and unlocked stowing regions 520, 524 may be defined within an otherwise largely open aperture 528 in interlocking floor panel 200 by a spacer, such as the generally square spacer 532 shown, that separates the two stowing regions. The length of spacer 532 will typically be determined by the length of the throw of locking member 508 between locked state 500 and unlocked state 504. The width of spacer 532 may be selected so that a length E of second portion 516 of locking member 508 extends beyond the spacer into a finger-access region 536 that allows a user to actuate the locking member via its second portion. As shown, finger-access region 536 extends through interlocking floor panel 200 so as to form an aperture that allows a user to access second portion 516 of locking member 508 from both sides of the floor panel. As described below, this configuration allows a user to readily insert or remove locking member 508 when desired. However, in alternative embodiments, finger-access region 536 may not extend all the way through interlocking floor panel 200. Finger-access region 536 may be sized such that objects larger than fingers, e.g., table legs and chair legs and rollers, will not fit therein, and, thus, unwanted tripping or instability of other items supported by interlocking floor panel 200 can be avoided. For example, each finger-access region 536 may have a length and width each in a range of about 0.75 inch (19 mm) to about 1.75 inches (44.4 mm). Of course, other dimensions may be used. In the embodiment shown, spacer 532 is molded integrally with the surrounding portions of interlocking floor panel 200. However, it should be understood that in other embodiments if a spacer is provided, it may be formed separately from the rest of the interlocking floor panel and subsequently attached thereto in a suitable manner.

If desired, the widths Wl, Wu (FIG. 7) of, respectively, locked and unlocked stowing regions 520, 524 may be any suitable width to accommodate second portion 516 of locking member 508 either loosely or with a friction fit, as desired. In the embodiment shown, widths Wl, Wu provide a loose fit for second portion 516 since they are slightly greater than the diameter of the second portion. Referring to FIG. 7, in this configuration, when second portion 516 is located in locked stow region 520 rotation of locking member 508 toward the underside of interlocking floor member 200 from the position shown is blocked by a spacer support 708. However, to facilitate the locking member removal/engagement scheme of this embodiment (described below), unlocked stowing region 524 extends all the way through interlocking floor panel 200. If it is unacceptable that second portion 516 be permitted to pivot downward from the position shown when locking member 508 is in stowed unlocked state 504, some sort of stop(s), such as stop 712, may be provided. To facilitate the locking member removal/engagement scheme, stop 712 can be sized to allow second portion 516 to pass upon application of a reasonable amount of force to the second portion to cause the second portion to pivot past the stop. Stop 712 shown is integrally molded with floor panel 200. In other embodiments, the sidewalls of unlocked stowing region 524 may be contoured to provide a similar inhibition to movement of second portion 516 beyond its position in stowed unlocked state. If desired, similar arrangements can be used in either or both of locked and unlocked stowing regions 520, 524 to inhibit pivoting of second portion 516 of locking member in a direction toward treading surface 220 of interlocking floor panel 200.

With continuing reference to FIG. 7, and referring also to FIG. 6, in this embodiment locking member 508 can be readily removed from and installed into locking mechanism 248 as follows. Starting, e.g., from stowed unlocked state 524, a user pushes second portion 516 of locking member 508 past stop 712 by pushing the second portion toward the viewer in FIG. 6. Once second portion 516 is past stop 712, it is essentially free to be rotated counterclockwise (relative to FIG. 6) so that the second portion extends toward the viewer in FIG. 6. When in this position, or, in this example, any other similar position where second portion 516 will clear the closest rib 304 (see also FIG. 3), the user can then slide locking member 508 out of channel 604 so that the tip of first portion 512 passes beyond spacer support 708. At this point, locking member 508 is free of the confines of the rest of locking mechanism 248. To engage locking member 508 or a similar locking member with locking mechanism 248, a user need only perform the foregoing process essentially in reverse. Care should be taken in locating ribs 304 (if provided) (FIG. 3) so as to not interfere with the installation/removal of locking member 508 to and from locking mechanism 248.

In addition to the foregoing, FIG. 7 also illustrates interlocking floor panel 200 engaged with, and locked to, like panel 700. Prior to locking interlocking floor panels 200, 700 together, as described above, entrance aperture 704 of interlocking floor panel 700 will become aligned with corresponding respective exit aperture 252 of floor panel 200 as the corresponding self-aligning tab 716 of interlocking floor panel 700 engages the receiver 244 of floor panel 200. The diameter of entrance aperture 704 may, if desired, be larger than the diameter of exit aperture 252 and/or the diameter of first portion 512 of locking member 508 to allow for a certain amount of movement, e.g., rotation, between interlocking floor panels 200, 700 to address, e.g., uneven terrain beneath the panels. Once entrance aperture 704 is suitably aligned with exit aperture 252, locking member 508 may be moved to stowed locked state 500 by pivoting and sliding it as needed from an unlocked state, such as stowed unlocked state 504. It will be appreciated that while locking mechanisms 248 (FIGS. 2-7) are shown as being located adjacent receivers 244, in other embodiments, they may be located adjacent tabs 240 or even in locations other than at receivers and tabs.

In addition, while interlocking floor panel 200 is shown as having two locking mechanism 248 on each of two sides, one or three or more locking mechanisms could be provided on each side. That said, stability, particularly on less-than-ideal ground, may be compromised if only one locking mechanism is provided (except if another one for that side is provided on an adjacent panel). Three or more locking mechanisms may be suitable if the panels are relatively flexible and they are supported by, e.g., loose soil and/or uneven ground. In other cases, having three or more locking mechanisms may not be needed and may only contribute to increases in the cost of the panels. In yet other embodiments, there may be two or more panel types, e.g., one having all of the locking mechanisms and the other having no mechanisms, but only entrance holes for receiving the locking members. As can be seen, there are a number of configurations of interlocking floor panels possible using features of floor panel 200 described above.

Referring still to FIG. 7, in some embodiments one or both of locked and unlocked stowing regions 520, 524 may be configured so that when second portion 516 of locking member 508 is in its respective stowed position, its free end is located closer to treading surface 220 than the end that is continuous with first portion 512. A benefit of this arrangement is that while second portion 516 of locking member 508 is still beneath treading surface 220 and, therefore, out of the way, it is more accessible to the fingers of a user than if the second portion were parallel to the treading surface or angled away from the treading surface. This "upwardly angled" positioning of second portion 516 of locking member 508 may be achieved in unlocked stowing region 524 by properly selecting the placement of stop 712 described above. Similarly, the upwardly angled positioning of second portion 516 of locking member 508 in locked stowing region 520 can be achieved by using one or more similar stops (not shown). If locking member 508 has a relatively loose fit within locking mechanism 248, it may be desirable to include additional stops (not shown) in each of stowing regions 520, 524 to hold second portion 516 of locking member 508 in place, e.g., during shipping and handling to keep the locking member from interfering with stacking and handling of interlocking floor panel. The force needed to move second portion 516 of locking member 508 past any one of these stops may be controlled by varying the amount of interference of that stop with the second portion. It is noted that in other embodiments one, some or all of the stops may be replaced by suitable crush ribs (not shown) that provide an interference fit for second portion 516 within the respective stowing region 520, 524.

Figure 8:
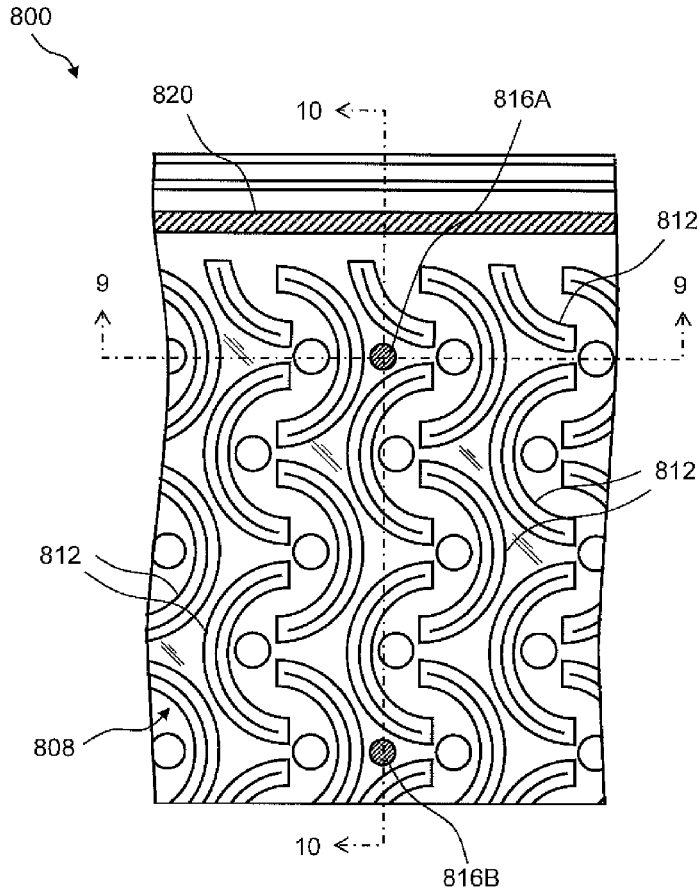
FIG. 8 is a partial top view of another example of a floor panel made in accordance with the present invention illustrating features that enhance stackability of multiple ones of the floor panel with one another.
Figure 9:
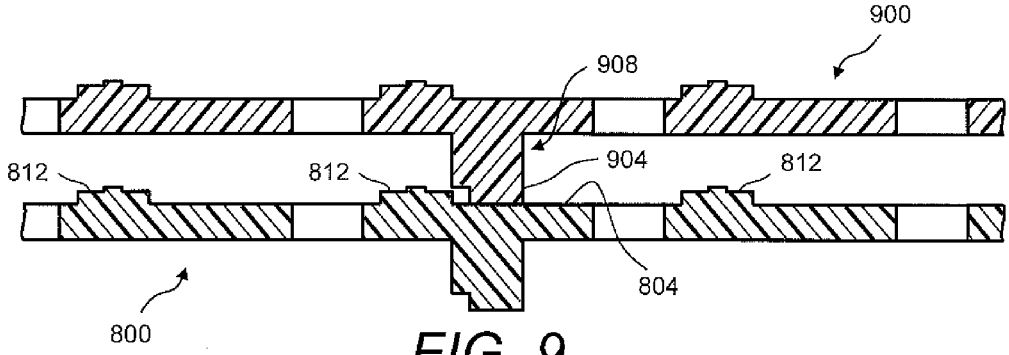
FIG. 9 is an enlarged cross-sectional view as taken along line 9-9 of FIG. 8 illustrating the floor panel of FIG. 8 stacked with another like panel.
Figure 10:
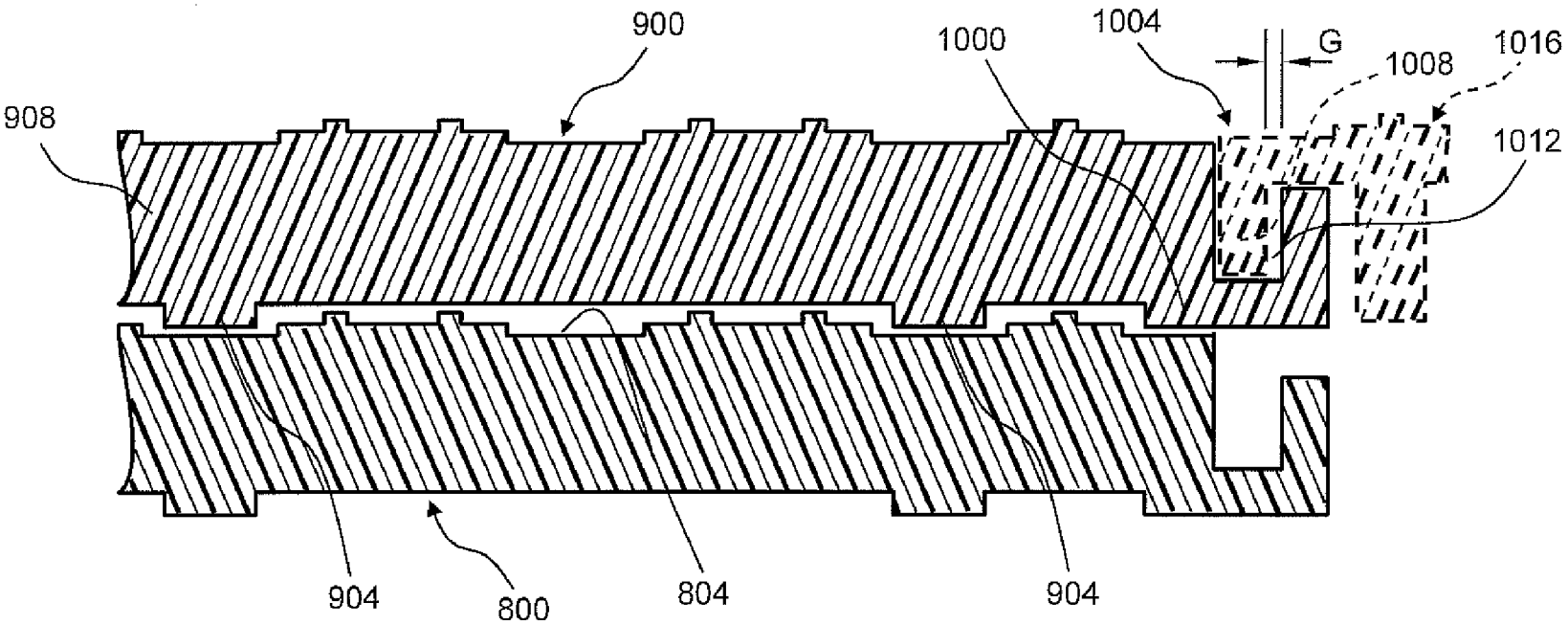
FIG. 10 is an enlarged cross-sectional view as taken along line 10-10 of FIG. 8 illustrating the floor panel of FIG. 8 stacked with a like panel, which is shown interlocked with another like floor panel to illustrate a tongue and groove configuration that allows relative rotation between the like floor panels.

FIGS. 8-10 illustrate another example of an interlocking floor panel 800 that includes, in addition to the features described above with respect to interlocking floor panel 200 of FIGS. 2-7, features for providing floor panel 800 enhanced stackability with one or more like flooring panels. In this example, treading surface 804 of interlocking floor panel 800 has textured pattern 808 that includes a plurality of raised traction ribs 812. In this example, when another interlocking floor panel (e.g., floor panel 900 of FIGS. 9 and 10) is properly stacked with interlocking floor panel, certain ones of the various regions between traction ribs 812 and outside of textured pattern 808 are engaged by corresponding respective structures on the other floor panel. In FIG. 8, these regions are illustrated by the hatched regions 816A-B, 820. Hatched regions 816A-B correspond to alignment lugs 904 (FIGS. 9 and 10) projecting from one of the stiffening ribs 908 on the underside of interlocking floor panel 900 and hatched region 820 corresponds to a perimeter flange 1000 that extends along the length of the edge 1004 of interlocking floor panel 900. As best seen in FIG. 8, alignment lugs 904, as represented as hatched regions 816A-B in FIG. 8, may be sized to have a fairly snug fit within the corresponding regions between traction ribs so as to limit that amount of sliding that can occur between stacked interlocking floor panels 800, 900 (see FIGS. 9 and 10). Similarly, textured pattern 808 and perimeter flange 1000 may be designed so that when interlocking floor panels 800, 900 are properly stacked, there is little, if any, play between the perimeter flange and the immediately adjacent traction ribs 812 along the edge of floor panel 800. It will be recognized that alignment lugs, such as alignment lugs 904, can be provided in any suitable number and at any suitable locations as desired to suit a particular design.

It will be understood by those of ordinary skill in the art that configuration of texture pattern 808, alignment lugs 904 and perimeter flange 1000 shown are merely exemplary and that many other configurations of these items can be developed to provide the corresponding interlocking floor panels with enhanced stackability. In addition, those of ordinary skill in the art will recognize that both perimeter flanges and alignment lugs need not necessarily be provided together. That is, in some embodiments, only perimeter flanges may be provided and in other embodiments, only alignment lugs may be provided. It should be recognized that although perimeter flange 1000 (FIG. 10) is illustrated only with respect to one edge 1104 of interlocking floor panel 900, it may be located along any edge having a groove and, if alignment structures similar to alignment tabs 240 (e.g., FIG. 4) are present, incorporated into such alignment structures.

In addition to illustrating stackability features of interlocking floor panels 800, 900, FIG. 10 also illustrates a configuration of tongue 1008 and groove 1012 (similar to tongue 236 and groove 232 of FIGS. 1 and 2) that, in conjunction with any locking mechanism present, if any, allows floor panel 900 and floor panel 1016 to rotated relative to one another while the tongue remains within the groove. In this example, groove 1012 is made wider than the thickness of tongue 1008 so that a gap, such as gap G, exists when the tongue is engaged with the groove and interlocking floor panels 900, 1016 lie along a common plane. In one example wherein the overall thickness of each interlocking floor panel 900, 1016 is 1 inch (2.54 cm), the width of groove 1012 is 0.312 inches (7.9 mm) and the thickness of tongue 1008 is 0.25 inches (6.4 mm), gap G is about 0.62 inches (1.6 mm). In this example, this configuration, in conjunction with a locking mechanism similar to locking mechanism 248 of FIGS. 2, 3 and 5-7, provides a maximum relative rotation between interlocking floor panels 900, 1012 that approaches 20°. In another example in which the overall thickness of each interlocking floor panel 900, 1016, the width of groove 1012 is 0.345 inches (8.8 mm) and the thickness of tongue 1008 is 0.25 inches (6.4 mm), gap G is about 0.095 inches (2.4 mm), which provides a maximum relative rotation of between about 10° and 20°. Of course, in other embodiments, gap G may be larger or smaller to suit a desired relative rotation.

Figure 11:
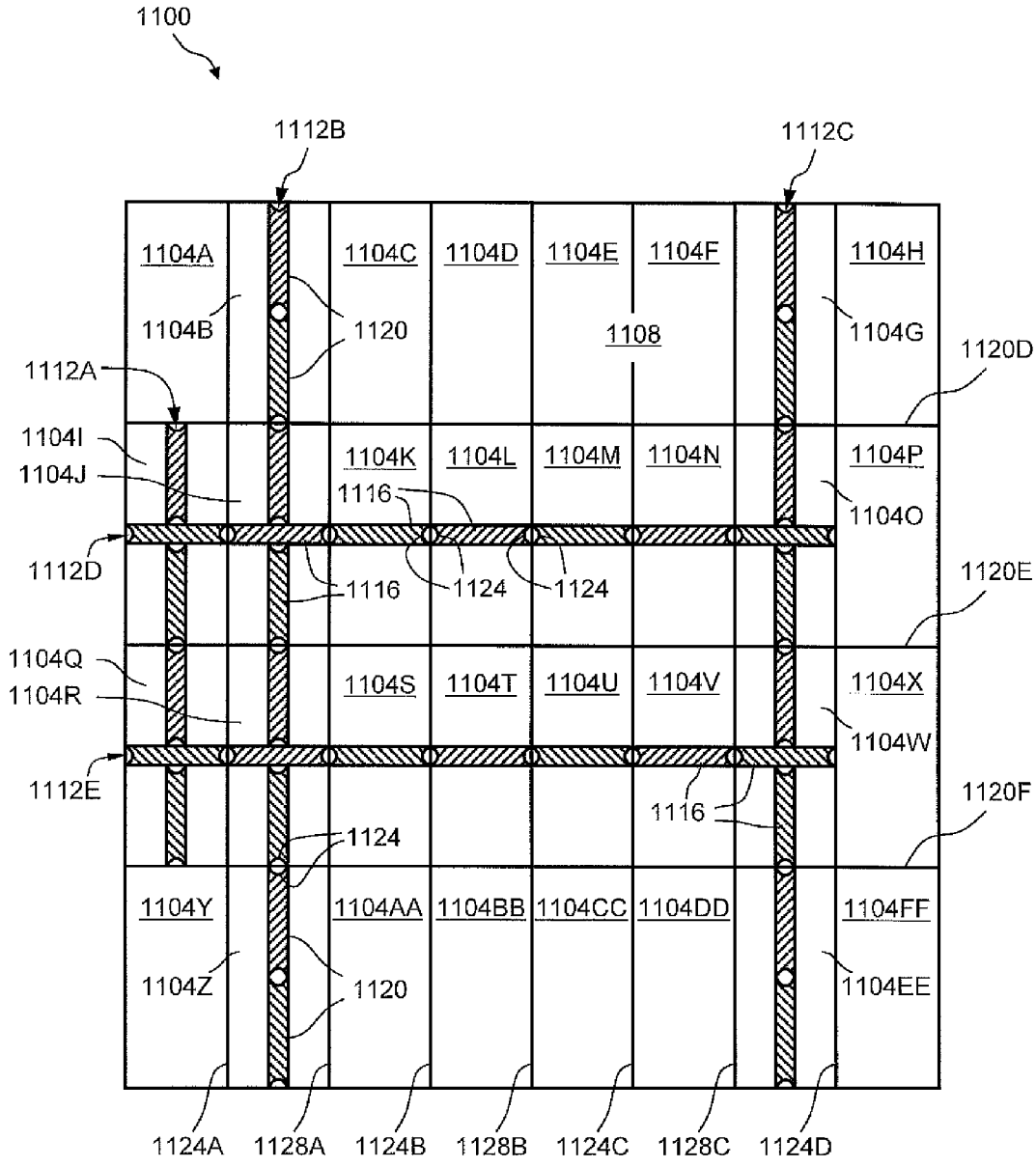
FIG. 11 is a schematic top view of yet another example of a modular flooring system made in accordance with the present invention having a plurality of conduit chases formed integrally with the floor panels.

FIG. 11 shows another example 1100 of a modular flooring system that comprises a plurality of interlocking floor panels, here 32 floor panels 1104A-FF, of differing types that together provide a floor 1108 that includes one or more conduit chases, in this example 5 conduit chases 1112A-E. A feature of modular flooring system 1100 of note is the way conduit chases 1112A-E are formed. Whereas conduit chases 804A-D of modular flooring system 800 of FIG. 8 are provided by runner and intersection modules 812, 816, 820 formed separately from floor panels 808A-P, conduit chases 1112A-E of modular flooring system 1100 of FIG. 11 are formed integrally with some of interlocking floor panels 1104A-FF. Relative to conduit chases 1112A-E there are four types of floor panels present among floor panels 1104A-FF, namely, a chaseless type (panels 1104A, 1104C-F, 1104G, 1104P, 1104X, 1104Y, 1104AA-DD, 1104FF), a long-direction-chase type (panels 1104B, 1104G, 1104Z, 1104EE), a short-direction-chase type (panels 1104K-N, 1104S-V) and an intersecting-chase type (1104I-J, 1104O, 1104Q-R, 1104W). An exemplary intersecting-chase type panel 1200 suitable for use as any one of floor panels 1104I-J, 1104O, 1104Q-R, 1104W is described below in detail in connection with FIGS. 12 and 13. As will also be described in more detail below, each interlocking floor panel 1104A-FF may include some or all of the features described above in connection with interlocking floor panel 200 of FIG. 2, such as tongued edges, edges having matching groove-defining extensions, self-aligning tabs, receivers for such tabs and locking mechanisms, among others.

In the embodiment shown in FIG. 11, each conduit chase 1112A-E is shown being covered by a plurality of covers 1116, 1120. In this example, due to the sizes selected for interlocking floor panels 1104A-FF and their corresponding respective portion(s) of conduit chases 1112A-E, only two cover sizes are needed, one size for covers 1116 of short-direction chases-type interlocking floor panels 1104K-N, 1104S-V and intersecting-chase-type floor panels 1104I-J, 1104O, 1104Q-R, 1104W and the other size for the long-direction-chase-type floor panels 1104B, 1104G, 1104Z, 1104EE. This is so in this example because each interlocking floor panel 1104A-FF is 48 inches (121.92 cm) long by 21 inches (53.34 cm) wide and the width of each channel 1112A-E is 6 inches (15.24 cm). With each cover 1116 having a length equal to the width of the panels, e.g., 21 inches, every short-direction segment of conduit chases 1112C-D, including the short-direction segments of intersecting-chase-type floor panels 1104I-J, 1104O, 1104Q-R, 1104W, takes a corresponding 21-inch (53.34 cm) cover. For intersecting-chase type panels 1104I-J, 1104O, 1104Q-R, 1104W, this leaves two 21-inch [(48 in.−6 in.)/2] segments in the long direction on each panel for receiving the same 21-inch-long cover 1116. Long-direction-chase-type floor panels 1104B, 1104G, 1104Z, 1104EE, being 48 inches long, require covers of a length other than 21 inches for full coverage. In this case, The segment of conduit chases 1112B-C in each of long-direction-chase-type floor panels 1104B, 1104G, 1104Z, 1104EE is covered by two contiguous 24 inch (60.96 cm) covers 1120. Each cover 1116, 1120 may include a notch 1124 or other void at one or both of its ends for allowing wires and/or cables to extend into and out of the corresponding respective conduit chase 1112A-E.

Referring now to FIG. 12, as mentioned above FIG. 12 illustrates a floor panel 1200 of the intersecting-chase type described above. Therefore, floor panel 1200 could be used, if desired, for any one of intersecting-chase-type floor panels 1104I-J, 1104O, 1104Q-R, 1104W identified in modular flooring system 1100 of FIG. 1. Of course, floor panel 1200 may be used in another modular flooring system as desired. In this example, floor panel 1200 includes intersecting conduit chases 1204, 1208 that each comprise two largely semi-cylindrical troughs 1204A-B, 1208A-B for receiving one or more wires, cables and/or other elongate conduits, such as wires 1212A-E. By placing wires 1212A-E in conduit chases 1204, 1208, the portions of the wires in the conduit chases are out of the way of foot traffic and other activities carried out after the floor panel and wires are installed. In the embodiment illustrated in FIG. 12, the areal dimensions of floor panel 1200 are the same as for each of floor panels 1104A-FF of FIG. 11, i.e., the width and length of floor panel 1200 are, respectively, 21 inches (53.34 cm) and 48 inches (121.92 cm). Likewise, the overall width of each conduit chase 1204, 1208 is the same at 6 inches (15.24 cm). The thickness of floor panel 1200 in this example is 2 inches (3.08 cm), which provides each conduit chase 1204, 1208 with a usable depth of about 1.5 inches (3.81 cm), subtracting the thicknesses of each cover 1216 and the wall thickness of each trough 1204A-B, 1208A-B at the bottom of that trough. Of course, all of these dimensions can be changed to suit a particular application. For example, the length and width dimensions of floor panel 1200 may be changed to achieve a desired panel size and the overall thickness of the floor panel and the widths of conduit chases 1204, 1208 may be changed to accommodate a certain number and size of conduits to be contained in the chases. Practical considerations for sizing flooring panel 1200 may be the handleability of panel at the one extreme and the desire to minimize the number of panels and installation time at the other extreme.

It is noted that while each conduit chase 1204, 1208 is shown as including two semicylindrical troughs 1204A-B, 1208A-B, each conduit chase may have more or fewer troughs and each trough may be another shape, such as rectangular, among others. That said, the dual-trough configuration shown can provide floor panel 1200 with good bending stiffness when the panel is flexed in a direction perpendicular to each conduit chase 1204, 1208 and the center partitions 1204C, 1208C of each chase provide intermediate support to the side-to-side spans of covers 1216, which allows the covers to be made thinner and, therefore, lighter and less costly to make. If needed, one or more supports, e.g., center support 1220, may be provided at the intersection of conduit chases 1204, 1208 to provide support to the overlying cover 1216 when the cover is installed. It is noted also that this design allows conduits routed in one trough 1204A-B, 1208A-B to be re-routed to the other trough at the mid-panel intersection point.

Figure 12:
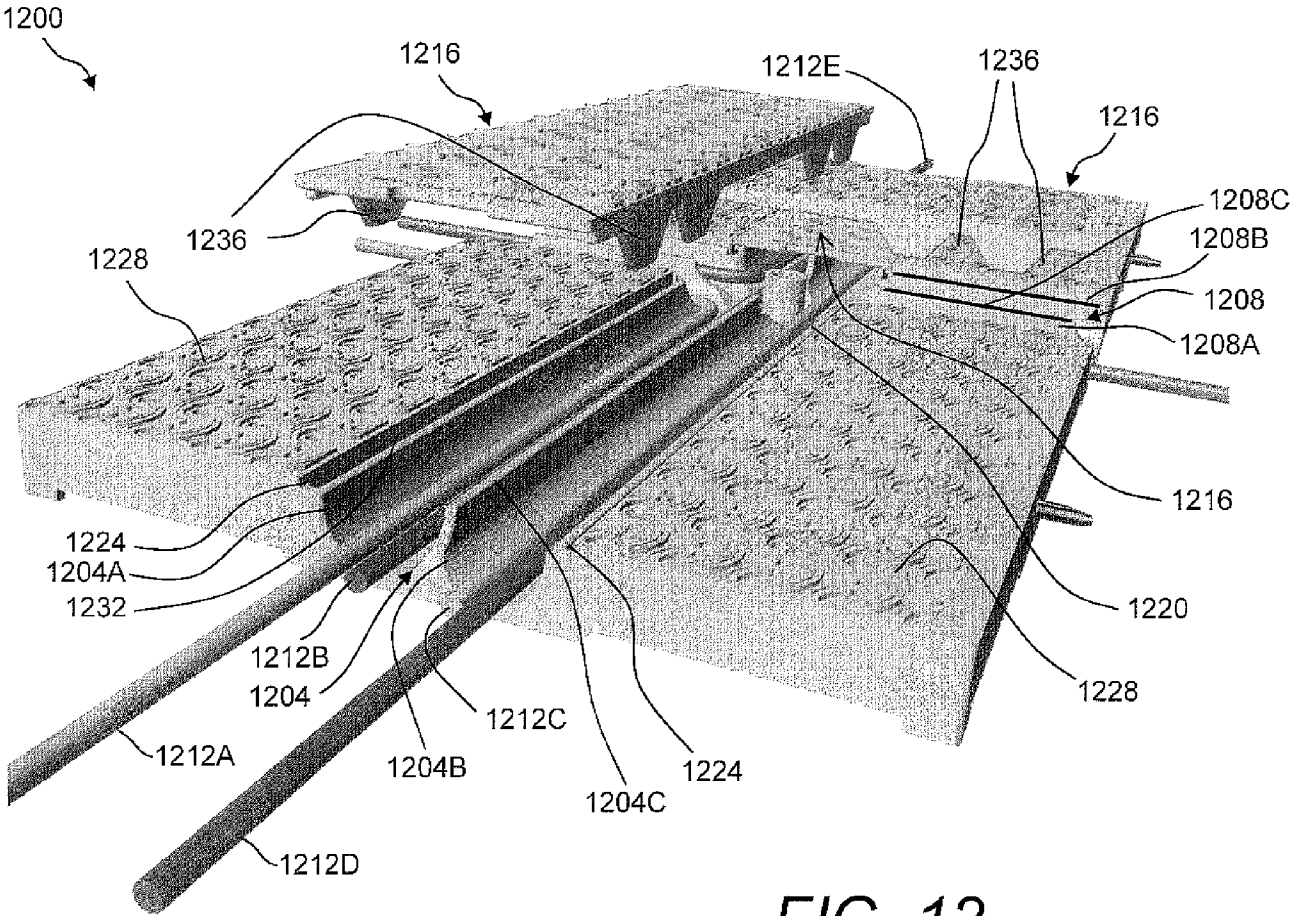
FIG. 12 is an enlarged, partially-exploded perspective view of a floor panel having integral conduit chases.
Figure 13:
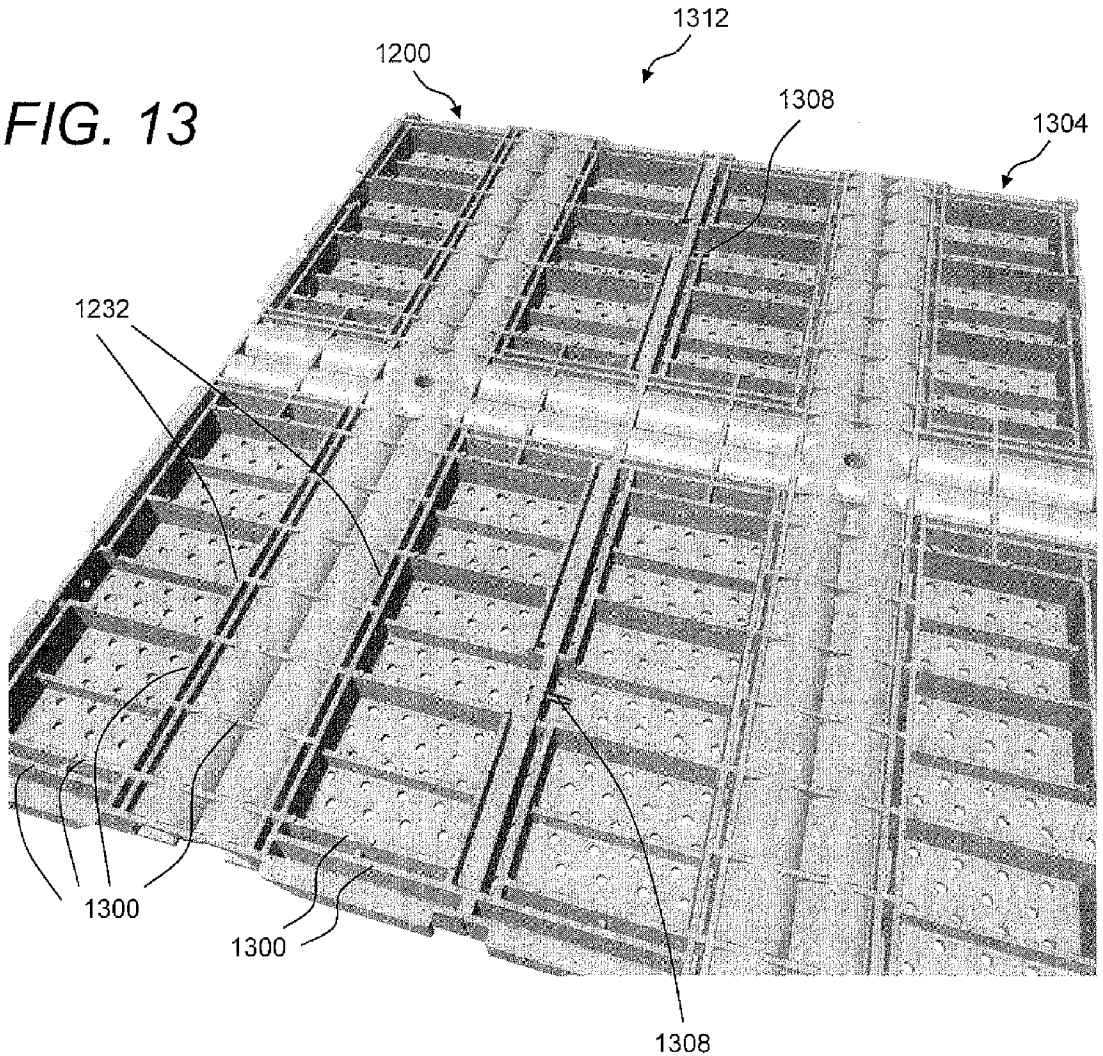
FIG. 13 is an enlarged, partial perspective view of a pair of the floor panel of FIG. 12 showing the bottom of the pair when preassembled into a preassembled floor panel.

Referring to FIG. 13, and also to FIG. 12, FIG. 13 illustrates one of many patterns of stiffeners 1300 that may be used on the reverse side of floor panel 1200 to make the floor panel suitably stiff while trying to keep the weight of the panel reasonable. Those skilled in the art will readily understand how to implement other stiffening patterns. Like interlocking floor panel 200 of FIG. 2, floor panel 1200 of FIGS. 11 and 12 may be made of any suitable material, such as a plastic or fiber-reinforced plastic, among others. The design depicted in FIGS. 11 and 12 make floor panel 1200 readily suited for injection molding. Of course, however, other fabrication methods can be used as dictated by, e.g., the design, material(s) of construction and/or availability of other methods.

Since exemplary panel 1200 is relatively narrow, at 21 inches, and relatively light, it may be desirable under some circumstances to secure two or more panels together at the manufacturing stage to create larger, but still readily handleable, preassembled flooring sheet. FIG. 13 illustrates such a situation in which a second floor panel 1304 identical to floor panel 1200 is secured to floor panel 1200, here using mechanical fasteners 1308 (also visible in FIG. 12), so as to provide a larger preassembled floor panel 1312. Mechanical fasteners 1308 may be any suitable mechanical fastener, such as a friction-type fastener, threaded fastener, rivet, clamp, spline, etc. The size of resulting preassembled floor panel 1312 in this case is 42 inches (106.68 cm) by 48 inches (121.92 cm), which is still a manageable size for even a single handler. This preassembly concept is also illustrated in FIG. 11 by relatively light vertical lines 1124A-D that represent joints formed prior to installation of modular flooring system 1100 and the relatively dark horizontal and vertical lines 1128A-F that represent joints formed in the field as the two-panel preassembled panels are installed. For example, flooring panels 1104A-B are preassembled with one another, flooring panels 1104C-D are preassembled with one another, flooring panels 1104E-F are preassembled with one another, and so on.

Still referring to FIGS. 12 and 13, FIG. 12 shows exemplary conduit chases 1204, 1208 as having side seats 1224 for supporting a corresponding respective cover 1216. Each side seat is spaced from treading surface 1228 of floor panel 1200 by a distance that provides slots 1232 for receiving corresponding respective tabs 1236 of covers 1216. As seen in FIG. 13, in this example slots 1232 are divided apart by intermediate stiffeners 1300. Consequently, tabs 1236 (FIG. 12) may be tapered to assist in aligning each cover 1216 as it is installed on the respective conduit chase 1204, 1208. Although each cover 1216 is shown as having four tabs 1236 per side, each side may have fewer or more tabs as desired to suit a particular design.

Figure 14:
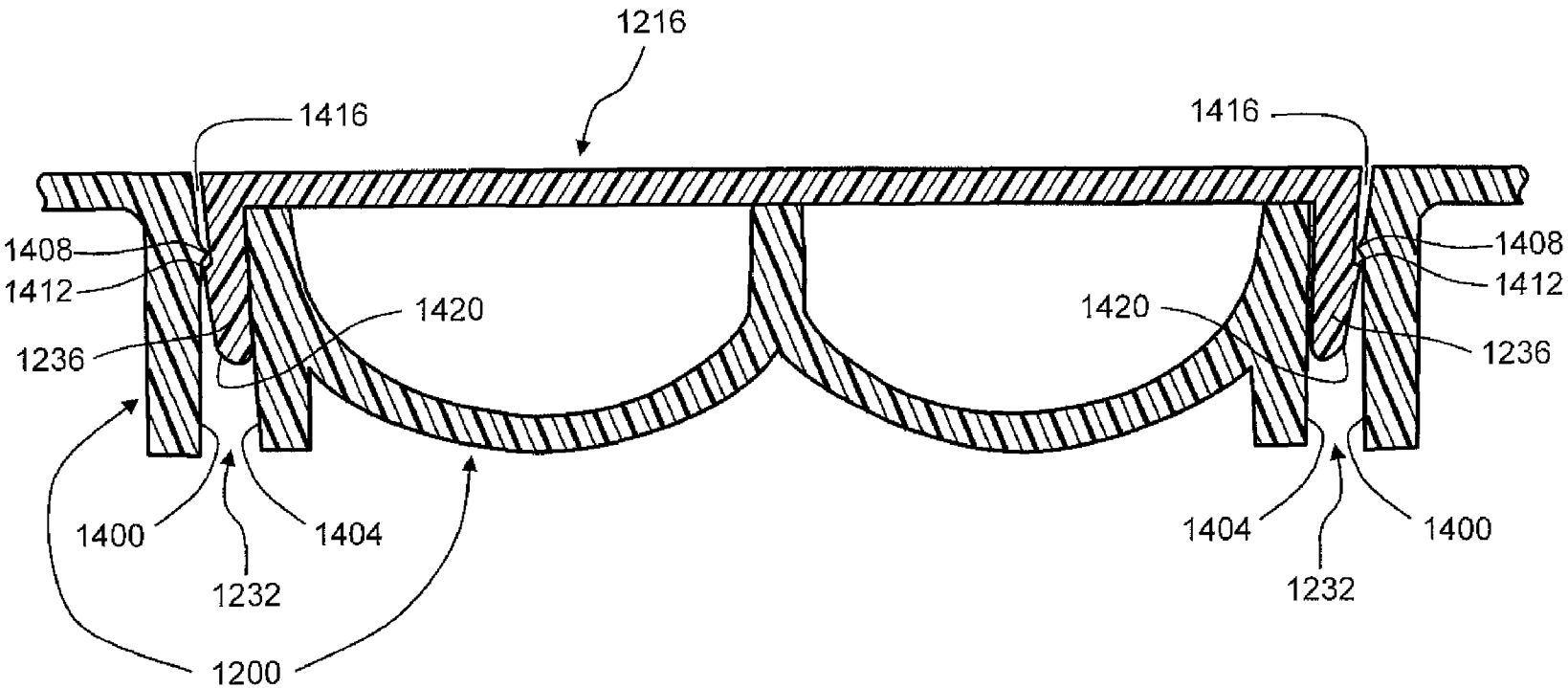
FIG. 14 is an enlarged partial cross-sectional view of one of the conduit chases of the floor panel of FIG. 12 illustrating the friction fit between the conduit chase cover and the floor panel.

Referring to FIG. 14, and also to FIG. 12, FIG. 14 illustrates one example of a design that provides a snap fit between cover 1216 and the rest of floor panel 1200. In this example, slot 1232 has substantially straight and parallel sidewalls 1400, 1404 spaced at a distance somewhat greater than the maximum thickness of tab 1236 of cover 1216. To facilitate the snap fit of cover 1216, each outer wall 1400 of slots 1232 includes a catch 1408 and each tab 1236 of the cover includes a shoulder 1412 for engaging the corresponding respective one of catches as shown. Each of catch 1408 and shoulder 1412 may extend the entire length of cover 1216. In alternative embodiments, the catches and shoulders may be provided in lengths shorter than the length of cover 1216 and may be placed at locations selected by a designer, such as at the opposing ends of cover (e.g., one set on each side of the cover at each end). Providing each cover 1216 with catches 1408 and shoulders 1412 is beneficial for providing good resistance against the cover from inadvertently becoming disengaged from the rest of floor panel 1200 during shipping, handling and use.

In this example, each tab 1236 is angled slightly outward from base to tip, or splayed outward, so that prior to installation the distance between the outer faces of the tabs is slightly greater than the distance between the outer walls 1400 of slots 1232. With this configuration, one or both tips of the opposing tabs 1236 must be moved toward the other to be inserted into both slots 1232. Since this movement is elastic, once tabs 1236 have been inserted into the corresponding respective slots 1232, there remains a biasing of the tabs against outer walls 1400 of the respective slots so as to provide a biased snap fit between shoulders 1412 and catches 1408 to provide an extra measure of resistance against cover 1216 being separated from the rest of floor panel 1200. If desired, a beveled or scalloped portion 1416 that angles away from cover 1216 may be provided to outer wall 1400 above each catch 1408 and/or a bevel 1420 may be provided to each tab 1236 to aid a user in installing the cover by guiding the respective outwardly splayed tabs into the corresponding slot 1232.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A modular flooring system, comprising:

a plurality of interlocking floor panels each including:

a rectangular treading surface having a first edge, a second edge spaced from said first edge, a third edge, and a fourth edge spaced from said third edge;

a first extension member extending laterally beyond said first edge and defining an upwardly opening first groove;

a second extension member extending laterally beyond said third edge and defining an upwardly opening second groove;

a first tongue below said second edge and extending substantially perpendicular to and away from said treading surface;

a second tongue below said fourth edge and extending substantially perpendicular to and away from said treading surface; and a plurality of locking mechanisms;

wherein:

said plurality of interlocking floor panels are interlocked with one another such that ones of said first tongues are engaged with ones of said first grooves, ones of said second tongues are engaged with ones of said second grooves, and said plurality of locking mechanisms are engaged so as to lock immediately adjacent panels to one another to hold ones of said first tongues in corresponding respective ones of said first grooves and to hold ones of said second tongues in corresponding respective ones of said second grooves;

each of said plurality of locking mechanisms comprises a recess in said treading surface and a locking member that includes a handle movable within said recess;

said locking member includes an L-shaped pin having a first portion slidably engagable with an immediately adjacent one of said plurality of interlocking floor panels, and a second portion that functions as said handle; and said recess includes a locked stowing region and an unlocked stowing region spaced from said locked stowing region, said locked stowing region receiving said second portion of said locking member in a stowed manner relative to said treading surface when that one of said plurality of locking mechanisms is in a locked state, and said unlocked stowing region receiving said second portion of said locking member in a stowed manner relative to said treading surface when that one of said locking mechanisms is in an unlocked state.

2. The modular flooring system of claim 1, wherein each of said first and second tongues includes a plurality of self-alignment tabs and each of said first and second extension members includes a plurality of self-alignment receivers conformally receiving corresponding respective ones of said plurality of self-alignment tabs.

3. The modular flooring system of claim 1, wherein said locked stowing region and said unlocked stowing region are spaced from one another by a spacer that extends upward toward said treading surface.

4. The modular flooring system of claim 1, wherein said second portion of said locking member is moved into and out of each of said locked stowing region and said unlocked stowing region by pivoting said second portion in a plane perpendicular to said treading surface.

5. The modular flooring system of claim 1, wherein each of said plurality of interlocking floor panels includes an underside opposite said treading surface, said recess including an opening that extends entirely through a corresponding one of said plurality of interlocking floor panels so that said second portion can be pivoted to extend through said underside.

6. The modular flooring system of claim 5, wherein said opening is located in said unlocked stowing region.

7. The modular flooring system of claim 6 wherein said unlocked stowing region includes a stop for inhibiting said second portion of said first locking member from inadvertently pivoting so as to extend through said underside.

* * * * *